US005236464A

United States Patent [19]

Green et al.

[11] Patent Number: 5,236,464

[45] Date of Patent: Aug. 17, 1993

[54] ACTIVATION OF NYLON FIBERS FOR MODIFICATION BY UV RADIATION

[75] Inventors: George D. Green, Park Ridge; Darryl K. Barnes, Bellwood; Lidia T. Calcaterra; Mathias P. Koljack, both of Arlington Heights, all of Ill.

[73] Assignee: Allied-Signal Inc., Morris Township, Morris County, N.J.

[21] Appl. No.: 808,118

[22] Filed: Dec. 16, 1991

[51] Int. Cl.[5] ..... D06M 14/34; B05D 3/06

[52] U.S. Cl. ..... 8/115.53; 8/115.6; 8/115.56; 8/115.62; 8/DIG. 21; 427/513; 427/519; 428/395

[58] Field of Search ..... 8/115.53, 115.52, DIG. 21, 8/115.6, 115.56, 115.62; 428/364, 359, 395; 204/157.87, 157.88; 427/54.1

[56] References Cited

U.S. PATENT DOCUMENTS

| | | | |
|---|---|---|---|
| 2,609,350 | 9/1952 | Spatt | 427/393.4 |
| 3,090,664 | 5/1963 | Cline et al. | 8/115.53 |
| 3,179,485 | 4/1965 | Kawasaki et al. | 8/115.53 |
| 4,401,688 | 8/1983 | Garnett et al. | 427/43.1 |
| 4,965,294 | 10/1990 | Ohngemach et al. | 522/79 |
| 5,001,004 | 5/1991 | Fitzgerald et al. | 428/263 |
| 5,118,551 | 6/1992 | Calcaterra et al. | 428/96 |

FOREIGN PATENT DOCUMENTS 329899 8/1989 European Pat. Off. .

*Primary Examiner*—Prince Willis, Jr.
*Assistant Examiner*—Alan D. Diamond
*Attorney, Agent, or Firm*—Harold N. Wells; Mary Jo Boldingh; Gerhard H. Fuchs

[57] ABSTRACT

The stain resistance of nylon fibers is improved by attaching stainblocking compounds to the fiber surface using agents which have been grafted to the nylon using UV light and a photoactivator.

15 Claims, No Drawings

ACTIVATION OF NYLON FIBERS FOR MODIFICATION BY UV RADIATION

BACKGROUND OF THE INVENTION

This invention relates to nylon fibers and particularly to their use in carpeting. More specifically, the invention relates to a method of improving the ability of nylon carpeting to resist staining and retaining such resistance even after cleaning.

There is much literature relating to the coating of nylon and other fibers to improve their surface properties and without affecting the physical properties of the nylon itself. The principal problem which has been faced by those working in the field of stain prevention has been retaining the ability to resist staining even after the nylon carpeting has been steam cleaned, a process which might better be called hot water-detergent washing. Surface treatments which are very effective at preventing the nylon from being stained are not usually resistant to the cleaning process to which most carpeting is eventually subjected. The present inventors have addressed this problem and found a method of firmly bonding stain-blocking compounds to the surface of nylon fibers, thus enabling them to resist the hot water washing process.

In, co-pending U.S. patent application Ser. Nos. 7/500,813 and 07/649,501 improved stain-blocking materials have been disclosed. Such materials may be D 30 firmly bonded to nylon by the process to be described below. Similar stain-blocking materials are disclosed in EP 0329,899.

The grafting of various materials to nylon and related polymers has been the subject of much investigation. In U.S. Pat. No. 3,090,664 Cline et al. disclosed a method of grafting an unsaturated organic acid or salt to nylon and other nitrogen containing polymers. The method involved placing the unsaturate acid on the surface of the polymer and then exposing it to ultraviolet light, thereby binding the unsaturated portion of the acid to the carbon adjacent to the nitrogen atom in the polymer chain. This process inherently leaves the acid portion free for further reaction. Photoinitiators were said not to be necessary, but they were preferred.

SUMMARY OF THE INVENTION

A process for improving the stain resistance of nylon fibers and for retaining such resistance after cleaning comprises contacting the nylon with a photoinitiator and an $\alpha,\beta$-unsaturated acid derivative (e.g., an ester or amide) having a functional group capable of reacting with a carboxylic acid group (e.g., an hydroxy or epoxy group) in the presence of ultraviolet light to graft the $\alpha,\beta$-unsaturated moiety to the nylon. Thereafter, a stainblocker compound having free carboxylic acid groups is reacted with the functional group attached to the nylon to produce a fiber which has good resistance to staining and which cannot be easily removed by conventional cleaning methods.

Preferred compounds which may be grafted to the nylon fibers include $\alpha,\beta$-unsaturated acid derivatives such as esters or amides in which the ester or amide moiety contains an hydroxy or epoxy group. Particularly preferred examples of such compounds include hydroxyethyl acrylate and N-methylol acrylamide which may be combined with pentaerythritol tetracrylate as an agent to improve the grafting.

The preferred stain-blocking compounds include copolymers of ethylenically unsaturated aromatic compounds and maleic anhydride, e.g., those disclosed in EP 0329 899 and particularly in co-pending applications 07/500,813 and 07/649,501, namely copolymers or terpolymers of aromatic-containing vinyl ethers and maleic anhydride, which are hydrolyzed or partially esterified and contain pendent free carboxylic acid groups. Preferred as the stain blocking compound is the copolymer of phenyl vinyl ether and maleic anhydride.

In one aspect, the invention is a stain resistant nylon fiber produced by the process described above.

DETAILED DESCRIPTION OF THE INVENTION

The process of the invention may be generally described as the UV grafting of an $\alpha,\beta$-unsaturated acid derivative, containing a functional group capable of reacting with an acid group to the surface of nylon fibers and then bonding the free carboxylic acid groups of stain blocker compounds to the nylon by reaction with the functional group of the acid derivative.

UV Grafting

The nylon fibers are first contacted with a UV photoactivator and then with a grafting agent which is an $\alpha,\beta$-unsaturated acid derivative, such as an ester or amide having a free hydroxyl or epoxy group. In the presence of ultraviolet light the grafting agent is reacted with the nylon surface, a carbon atom from the $\alpha,\beta$ unsaturation reacting with the carbon atom adjacent to the nitrogen atom in the nylon polymer. This grafting step leaves a free hydroxyl or epoxy group available to reaction with the stain blocker.

Many photoinitiators can be employed which have been found to be useful in UV facilitated reactions. General classes of such photoinitiators include the general classes mentioned in U.S. Pat. No. 3,090,664, namely vicinal dicarbonyl compounds, aromatic diketones, acyloins, acyloin ethers, $\alpha$-hydrocarbonsubstituted aromatic acyloins, diaryl ketones, and organic disulfides. Examples of compounds which are useful are benzophenone, acetophenone, IRGACURE 184 (phenyl hydroxy cyclohexyl ketone), diethoxyacetophenone, and benzoin ethers.

These photoactivators should be compatible with the nylon fibers and when contacted with nylon should be absorbed into the fibers and remain there until the grafting agent is applied. In general, the most useful photoactivators will be emulsified in water to concentrations of about 0.01 to 10 wt %. The fibers (or carpeting) will be contacted with the emulsion of the photoactivator for a suitable period of time to allow sufficient uptake of the photoactivator, for example about 0.5 to 30 minutes. Then, the fibers will be dried to remove excess liquid and brought into contact with the grafting agent. Simultaneous application of the photoactivator and the grafting agent may be used, although it is not preferred.

The grafting agents will have functional groups, preferably hydroxyl or epoxy groups, which remain available after the agent is grafted to the nylon surface. Preferably, the grafting agents will be hydroxyl-containing $\alpha,\beta$-unsaturated acid derivatives, such as the esters or amides of such acids, for example acrylates, methacrylates, maleates, fumarates, itaconates, acrylamides, methacrylamides, maleamides, fumaramides, itaconamides, and the like. Instead of hydroxyl-containing compounds the corresponding glycidyl compounds may be used.

Preferred grafting agents are hydroxyethyl acrylate and N-methylol acrylamide. Pentaerythritol tetraacrylate may be used to improve grafting. Other compounds which may have use are hydroxy-containing allyl compounds, such as allyl alcohol.

The grafting compounds will be contacted with the nylon fibers after they have been treated with the photoinitiator and then exposed to UV light centered at about 350 nm to graft the compound to the surface of the nylon. Such exposure will be with a light intensity of about 0.1 $J/cm^2$ to 50 $J/c^2$ for a suitable period of time to accomplish the grafting, usually about 0.01 to 5 minutes.

It will be desirable to interrupt the process at this stage so that the fiber can be processed further, for example, application of dyes, since the stainblocking compounds would be likely to interfere with the dyes. It is an advantage of the process of the invention that carpet fibers can be pretreated before use by the carpeting manufacturer and the stainblocking compound can be applied after the carpeting has been made without special equipment being required in the application of the stainblocker. Yet, the stainblocker is firmly attached to the nylon fibers by reaction with the grafted compound.

Stainblockers

Many stainblocking compounds are known to those skilled in the art. While others such as sulfonated phenol formaldehyde condensates or analogs are not excluded from use in the present invention, copolymers of ethylenically unsaturated aromatic compounds and maleic anhydride, such as the compounds disclosed in EP 0329 /899, copending U.S. patent application Nos. 07/500,813 and 07/649,50 are preferred. In general, the stainblocker selected will have the ability to react with the grafting compounds described above which have functional groups available for reaction with the stainblocker. The stainblockers have free carboxylic acid (or ester) groups derived from the maleic anhydride and can react with the free hydroxyl (or epoxy) groups of the grafting agent to attach the stainblocker to the surface of the nylon, thus causing the stainblockers to retain their effectiveness even after hot water-detergent washing.

In one copending application, U.S. Ser. No. 07/500,813, the stainblocking composition is generally described as a hydrolyzed aromatic-containing vinyl ether-maleic anhydride copolymer, or a half-ester of such a copolymer. By half-ester was meant the ester produced when a lower alcohol was reacted with the anhydride groups so that some of the anhydrides remain unreacted and of those that react, only one of the two carboxylic acid groups is esterified. A preferred copolymer combines phenyl vinyl ether and maleic anhydride. The amount used to provide stainblocking properties is said to be about 0.2 to 3.0 weight percent, based on the substrate (nylon). It is applied in an aqueous solution at a temperature of about 20° to 90° C. and a pH ranging from about 2 to 9.

In the other copending application, U.S. Ser. No. 07/649,501, the stainblocking compounds are mixtures of phenyl vinyl ether/maleic diacid copolymer (I) and 2-(4hydroxymethyl phenoxy)ethyl vinyl ether/maleic diacid copolymer (II). The two copolymers are used in ratios of 50 to 80% of the copolymer (I) and 50 to 20% of copolymer (II). The mixture of copolymers is applied as in aqueous solution having a concentration of 1-2 wt. % at a pH of about 4-4.5, a temperature of about 50° to 100° C. and then dried at 105° to 120° C. for at least 20 minutes. In another alternative, a terpolymer of the aromatic vinyl ethers described above with maleic anhydride may be used. The terpolymer may include about 35 to 40 mol. % phenyl vinyl ether, 15 to 10 mol. % 2-(4-hydroxy methyl phenoxy)ethyl vinyl ether, and 50 mol. % maleic anhydride.

Although the polymers just described are preferred stainblockers, particularly since they have carboxylic acid groups which react with the hydroxyl groups associated with the grafting agents previously described, other stainblocking agents may be used where they are capable of reacting with the grafting agent applied to the nylon fibers. Examples of other stainblocking materials which may have application in the invention include carboxylic acid-containing sulfonated aromatic condensates.

Process Considerations

Specific aspects of the process by which the stainblockers may be applied to nylon fibers have been discussed above. In general, the process may be considered to have three steps, although in practice these may not have to be distinct procedures. First, the nylon fibers are impregnated with a UV photoactivator, then the grafting agent is applied and the grafting completed using ultraviolet light, and finally the stainblocking materials are applied to bind them to the nylon surface through the grafting agent. These steps may be carried out in a series of steps at substantially the same time during the manufacture of carpeting, or more likely, they will be carried out at different times which are convenient. In one likely scenario, the fiber maker would apply the UV photoactivator to the fiber as it is produced and then graft the bonding agent to the fiber using ultraviolet radiation. The fiber would thereafter be sent to the carpet manufacturer who would dye the fiber, weave the carpet, and then apply the stainblocker of choice. Alternatively, the carpeting could be woven and then all three steps of the inventive process would be applied. A distinct advantage of the process of the invention is that it is not necessary to carry out all three steps simultaneously.

EXAMPLE 1

An emulsion of the photoactivator benzophenone (2.5 gm) and a surfactant Nipol 5690 (1.6 gm) supplied by Stepan Chemical was made by placing the two components in a 500 mL erlenmeyer flask and warming to obtain a homogeneous melt. 300 mL of water was added with vigorous stirring and then the mixture was placed in a sonicator (Branson 1200) at 50° C. and held for 2 hours. The emulsion was ready for impregnating nylon fibers.

EXAMPLE 2

A Nylon 6 continuous filament yarn was passed through a treatment bath containing the emulsion produced in Example 1. The dried fiber was partially dried in a stream of hot nitrogen (80° C.) and collected on a take-up reel. The dried fiber was then washed in cold water for 45-90 minutes and air dried. The concentration of the photoactivator in the nylon fiber was determined by UV spectroscopy. The temperature and residence time for the yarn in the bath was varied and the results for a series of tests is given in the table below.

TABLE A

| Sample # | Bath Temperature (°C.) | Bath Residence Time (min) | Emulsion Concentration (W/W, %) | Fiber Loading (W/W, %) |
|---|---|---|---|---|
| 1 | 30 | 9.0 | 0.17 | 0.12 |
| 2 | 30 | 1.0 | 0.17 | 0.23 |
| 3 | 70 | 12.0 | 0.17 | 1.14 |
| 4 | 70 | 1.0 | 0.17 | 0.56 |
| 5 | 70 | 6.3 | 0.83 | 1.22 |
| 6 | 70 | 1.0 | 0.83 | 0.53 |

Additional samples were prepared using Iragure 184 (0.1 wt. % from 1.5 wt. %) using the procedures of Examples 1 and 2.

EXAMPLE 3

A series of fiber samples prepared as described in Examples 1 and 2 and impregnated with about 1 wt. % benzophenone and IRAGURE 184 (phenyl hydroxy cyclohexyl ketone) were immersed in aqueous solutions or emulsions of grafting agents. The fibers were then partially dried using hot nitrogen (80° C.) and then passed through a nitrogen purged reactor where they were exposed to broad band UV light centered at 350 nm and an intensity of about $1\times10^{-7}$ einstein/sec (Rayonet) for 3 minutes. After radiation, the fibers were collected on a take-up reel and washed with cold water for 6 hours. After air drying for 2 days the samples were weighed and the amount of the grafting agents on the samples was determined. The results are shown in the following table.

TABLE B

| Sample # | Photoactivator | Grafting Agent(s)* | Treatment Soln. Concentration (W/W, %) | Agent/ Fiber (W/W, %) |
|---|---|---|---|---|
| 7 | NONE | NMA(3)/ PETA(1) | 6.7 | None Detected |
| 8 | NONE | NMA(6.5)/ PETA | 14.2 | None Detected |
| 9 | NONE | NMA(7.5)/ PETA(1) | 28.3 | None Detected |
| 10 | BENZO-PHENONE | NMA(3)/ PETA(1) | 6.7 | 1.8 |
| 11 | BENZO-PHENONE | NMA(6.5)/ PETA(1) | 14.2 | 1.5 |
| 12 | BENZO-PHENONE | NMA(7.5)/ PETA(1) | 28.3 | 2.3 |
| 13 | BENZO-PHENONE | HEA | 7.5 | 1.8 |
| 14 | IRGACURE 184 | HEA | 7.5 | 5.7 |
| 15 | IRGACURE 184 | NMA | 7.5 | 45.1 |

*NMA, PETA and HEA refer to N-methylol acrylamide, pentaerythritol tetraacrylate and hydroxyethyl acrylate respectively. The numbers in parentheses refer to the relative amounts of the grafting agents in the treating solution.

EXAMPLE 4

A stainblocker was attached to nylon fibers treated as in Example 3. Nylon 6 fiber treated with 2.8 wt. % hydroxy ethyl acrylate as in Example 3 was subsequently treated with a 1.3% wt. aqueous solution of the sodium salt of phenyl vinyl ether/maleic diacid copolymer containing a catalytic amount (7.5 wt. %) of p-toluene sulfonic acid (pH 5.0) at 70° C. for 15 minutes. The fiber was removed and squeezed to remove excess solution, leaving about 260% of the solution based on the weight of the fiber. This corresponded to about 3.4 wt. % of the stainblocker. The fiber was dried in a 115° C. oven for 40 minutes.

EXAMPLE 5

Another sample of Nylon 6 fiber containing 2.8 wt. % hydrogen ethyl acrylate was treated and the diacid form of the stainblocker of Example 4, using a trifluorotoluene/THF solution (84/16) rather than water as a solvent. Again, a catalytic amount of p-toluene sulfonic acid was used. The fiber was exposed to the solution under reflux conditions for 2 hours and then air dried. The remaining solution was sprayed onto the fiber and then the fiber was oven dried at 115° C. for 50 minutes. The amount of stainblocker on the fiber was found to be 1.4 wt. %.

Still another fiber sample was treated in the same manner except that the isopropyl ester of the stainblocker was used instead of the diacid (about 70% of the acid groups was esterified).

EXAMPLE 6

A standard test for detergent resistance was applied to samples prepared as described in the above examples and compared with control fibers having no treatment. The fiber samples were immersed in a large excess of a 60° C. solution of ALL-IN-ONE soap (50 mL) with agitation for 5 minutes. The samples were then rinsed with deionized water, patted dry with paper towels and oven dried at 115° C. for 10 minutes.

The ability of the fibers to resist staining was measured by exposure to an aqueous solution of unsweetened cherry flavored Kool-Aid TM. Nylon 6 fibers were placed in a vial that contained Kool-Aid solution, shaken briefly and allowed to stand for 1.5 minutes, then, the solution was shaken again and left for 1 minute. The Kool-Aid was removed and the fiber allowed to stand for 4 hours, after which it was rinsed with cold water, air dried and evaluated form stain-resistance, using a standard set of colored films. The results are given in the following table.

TABLE C

| Sample | Stainblocker | Application Method | Detergent Washed | Stain Rating(3) |
|---|---|---|---|---|
| Nylon-6 Control | None | NA | Yes | 9.0 |
| Nylon-6 Control | Diacid(1) | Aqueous | No | 0.0 |
| Nylon-6 Control | Diacid | Aqueous | Yes | 9.0 |
| Nylon-6/ 2.8% HEA | Diacid | Aqueous | No | 0.0 |
| Nylon-6/ 2,8% HEA | Diacid | Aqueous | Yes | 6.0 |
| Nylon-6/ 2.8% HEA | Diacid | Solvent | Yes | 1.5 |
| Nylon-6/ 2.8% HEA | Isopropyl(2) Ester | Solvent | Yes | 9.0 |

(1)diacid is phenyl vinyl ether/maleic diacid copolymer
(2)isopropyl ester is phenyl vinyl ether/maleic isopropyl ester copolymer
(3)0 means no observed stain 10 means severe stain From the data presented in the above table it can be seen that with no stainblocker the nylon fiber was badly stained (10 is the maximum rating). The stainblocker protected the nylon fiber completely, whether a grafting agent (HEA) was applied or not. However, the stainblocker was removed by detergent washing and the fiber was badly stained when no grafting agent was applied. The presence of the grafting agent gave an improvement in stain resistance and the application of the stainblocker in a solvent gave better results than aqueous application. The half ester of isopropyl alcohol did not retain stain resistance and presumably was lost during the detergent washing step.

We claim:

1. A process for improving the stain resistance of nylon fibers comprising:

(a) applying a UV photoactivator to said nylon fibers;

(b) grafting to the fibers of (a) using UV light an $\alpha,\beta$-unsaturated acid derivative containing a functional group reactive with a carboxylic acid group;

(c) attaching a stainblocking compound containing carboxylic acid groups to the reactive functional groups of the $\alpha,\beta$-unsaturated acid derivatives of (b).

2. The process of claim 1 wherein said UV photoactivator is selected from the group consisting of benzophenone, phenyl hydroxy cyclohexyl ketone, 4,4'-dialkoxybenzophenone, and benzoin ethers.

3. The process of claim 2 wherein said UV photoactivator is benzophenone.

4. The process of claim 2 wherein said UV photoactivator is phenyl hydroxy cyclohexyl ketone.

5. The process of claim 1 wherein said $\alpha,\beta$-unsaturated acid derivative is an ester or amide and said reactive functional group is an hydroxy group or an epoxy group.

6. The process of claim 5 wherein said $\alpha,\beta$-unsaturated acid derivative is an ester and said reactive functional group is an hydroxy group.

7. The process of claim 6 wherein said $\alpha,\beta$-unsaturated acid derivative is hydroxy ethyl acrylate optionally containing pentaerythritol tetracrylate.

8. The process of claim 5 wherein said $\alpha,\beta$-unsaturated acid derivative is an amide and said reactive functional group is an hydroxy group.

9. The process of claim 8 wherein said amide is N-methylol acrylamide optionally containing pentaerythritol tetracrylates.

10. The process of claim 1 wherein said UV light is centered at about 350 nm and has an intensity of about 0.1 to 50 $J/cm^2$.

11. The process of claim 1 wherein said stainblocking compound is a copolymer of an ethylenically unsaturated aromatic compound and maleic anhydride which is hydrolyzed or partially esterified.

12. The process of claim 1 wherein said stainblocking compound of (c) is a copolymer of phenyl vinyl ether and maleic anhydride.

13. The process of claim 1 wherein said stainblocking compound of (c) is a mixture of phenyl vinyl ether/-maleic diacid copolymers and 2-(4-hydroxy methyl phenoxy)ethyl vinyl ether/maleic diacid copolymers.

14. The process of claim 1 wherein said stainblocking compound of (c) is a terpolymer of phenyl vinyl ether, 2(4-hydroxy methyl phenoxy)ethyl vinyl ether, and maleic anhydride.

15. A stain resistant nylon fiber produced by the process of claim 1.

* * * * *